US006095385A

United States Patent [19]

Utu et al.

[11] Patent Number: 6,095,385

[45] Date of Patent: Aug. 1, 2000

[54] HOCKEY EQUIPMENT BAG

[76] Inventors: Lemigao Utu; Alice Utu, both of 303 Nicholas Crescent, Aldergrove, BC, Canada, V4W-3K9

[21] Appl. No.: 09/325,506

[22] Filed: Jun. 3, 1999

[51] Int. Cl.[7] ..... A45F 4/02; A45F 3/04

[52] U.S. Cl. ..... 224/153; 190/18 A; 206/315.1; 224/628; 224/652; 224/653; 224/657; 224/680

[58] Field of Search ..... 224/153, 628, 224/652, 653, 657, 680, 681; 190/18 A; 206/315.1

[56] References Cited

U.S. PATENT DOCUMENTS

| | | | |
|---|---|---|---|
| 4,842,032 | 6/1989 | Mastronardo | 190/903 |
| 5,730,347 | 3/1998 | Finot | 224/628 |
| 5,743,447 | 4/1998 | McDermott | 224/657 |
| 5,758,767 | 6/1998 | Hincher | 260/315.1 |
| 5,826,771 | 10/1998 | Peng | 224/651 |
| 5,845,780 | 12/1998 | Allen | 206/315.1 |
| 5,927,581 | 7/1999 | Reddy | 224/153 |
| 5,961,017 | 10/1999 | Mehler | 224/153 |
| 5,984,154 | 6/1989 | Scicluna | 224/153 |

*Primary Examiner*—Stephen P. Garbe

[57] ABSTRACT

A hockey equipment bag for carrying and storing hockey equipment in an organized manner. The hockey equipment bag includes a main compartment with a spaced apart pair of ground engaging wheels rotatably mounted to a bottom panel of the main compartment. A back panel of the main compartment has a spaced apart pair of shoulder straps coupled thereto. A top panel of the main compartment has a handle strap coupled thereto. A lower front compartment is coupled to the front panel of the main compartment. The front panel of the main compartment has a spaced apart pair of substantially parallel elongate slits into the main compartment. A first side panel of the main compartment has a shoulder strap coupled thereto. Upper and lower side compartments are coupled to the first side panel. The lower side compartment has generally L-shaped pocket therein. An elongate tubular shaft sleeve coupled to the first side panel adjacent the back panel of the main compartment.

10 Claims, 2 Drawing Sheets

HOCKEY EQUIPMENT BAG

BACKGROUND OF THE INVENTION

1. Field of the Invention

The present invention relates to hockey equipment bags and more particularly pertains to a new hockey equipment bag for carrying and storing hockey equipment in an organized manner.

2. Description of the Prior Art

The use of hockey equipment bags is known in the prior art. More specifically, hockey equipment bags heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,629,202 by Nelson et al.; U.S. Pat. No. 3,953,045 by Feret, Jr.; U.S. Pat. No. Des. 333,038 by Collins; U.S. Pat. No. 4,375,847 by Picco; U.S. Pat. No. Des. 357,351 by Kelsall; and U.S. Pat. No. 1,581,061 by Johnston.

While these devices fulfill their respective, particular objectives and requirements, the aforementioned patents do not disclose a new hockey equipment bag. The inventive device includes a main compartment with a spaced apart pair of ground engaging wheels rotatably mounted to a bottom panel of the main compartment. A back panel of the main compartment has a spaced apart pair of shoulder straps coupled thereto. A top panel of the main compartment has a handle strap coupled thereto. A lower front compartment is coupled to the front panel of the main compartment. The front panel of the main compartment has a spaced apart pair of substantially parallel elongate slits into the main compartment. A first side panel of the main compartment has a shoulder strap coupled thereto. Upper and lower side compartments are coupled to the first side panel. The lower side compartment has generally L-shaped pocket therein. An elongate tubular shaft sleeve coupled to the first side panel adjacent the back panel of the main compartment.

In these respects, the hockey equipment bag according to the present invention substantially departs from the conventional concepts and designs of the prior art, and in so doing provides an apparatus primarily developed for the purpose of carrying and storing hockey equipment in an organized manner.

SUMMARY OF THE INVENTION

In view of the foregoing disadvantages inherent in the known types of hockey equipment bags now present in the prior art, the present invention provides a new hockey equipment bag construction wherein the same can be utilized for carrying and storing hockey equipment in an organized manner.

The general purpose of the present invention, which will be described subsequently in greater detail, is to provide a new hockey equipment bag apparatus and method which has many of the advantages of the hockey equipment bags mentioned heretofore and many novel features that result in a new hockey equipment bag which is not anticipated, rendered obvious, suggested, or even implied by any of the prior art hockey equipment bags, either alone or in any combination thereof.

To attain this, the present invention generally comprises a main compartment with a spaced apart pair of ground engaging wheels rotatably mounted to a bottom panel of the main compartment. A back panel of the main compartment has a spaced apart pair of shoulder straps coupled thereto. A top panel of the main compartment has a handle strap coupled thereto. A lower front compartment is coupled to the front panel of the main compartment. The front panel of the main compartment has a spaced apart pair of substantially parallel elongate slits into the main compartment. A first side panel of the main compartment has a shoulder strap coupled thereto. Upper and lower side compartments are coupled to the first side panel. The lower side compartment has generally L-shaped pocket therein. An elongate tubular shaft sleeve coupled to the first side panel adjacent the back panel of the main compartment.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new hockey equipment bag apparatus and method which has many of the advantages of the hockey equipment bags mentioned heretofore and many novel features that result in a new hockey equipment bag which is not anticipated, rendered obvious, suggested, or even implied by any of the prior art hockey equipment bags, either alone or in any combination thereof.

It is another object of the present invention to provide a new hockey equipment bag which may be easily and efficiently manufactured and marketed.

It is a further object of the present invention to provide a new hockey equipment bag which is of a durable and reliable construction.

An even further object of the present invention is to provide a new hockey equipment bag which is susceptible of a low cost of manufacture with regard to both materials and labor, and which accordingly is then susceptible of low prices of sale to the consuming public, thereby making such hockey equipment bag economically available to the buying public.

Still yet another object of the present invention is to provide a new hockey equipment bag which provides in the apparatuses and methods of the prior art some of the advantages thereof, while simultaneously overcoming some of the disadvantages normally associated therewith.

Still another object of the present invention is to provide a new hockey equipment bag for carrying and storing hockey equipment in an organized manner.

Yet another object of the present invention is to provide a new hockey equipment bag which includes a main compartment with a spaced apart pair of ground engaging wheels rotatably mounted to a bottom panel of the main compartment. A back panel of the main compartment has a spaced apart pair of shoulder straps coupled thereto. A top panel of the main compartment has a handle strap coupled thereto. A lower front compartment is coupled to the front panel of the main compartment. The front panel of the main compartment has a spaced apart pair of substantially parallel elongate slits into the main compartment. A first side panel of the main compartment has a shoulder strap coupled thereto. Upper and lower side compartments are coupled to the first side panel. The lower side compartment has generally L-shaped pocket therein. An elongate tubular shaft sleeve coupled to the first side panel adjacent the back panel of the main compartment.

Still yet another object of the present invention is to provide a new hockey equipment bag that has ground engaging wheels to let a user roll the bag across a ground surface when traversing the ground surface.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
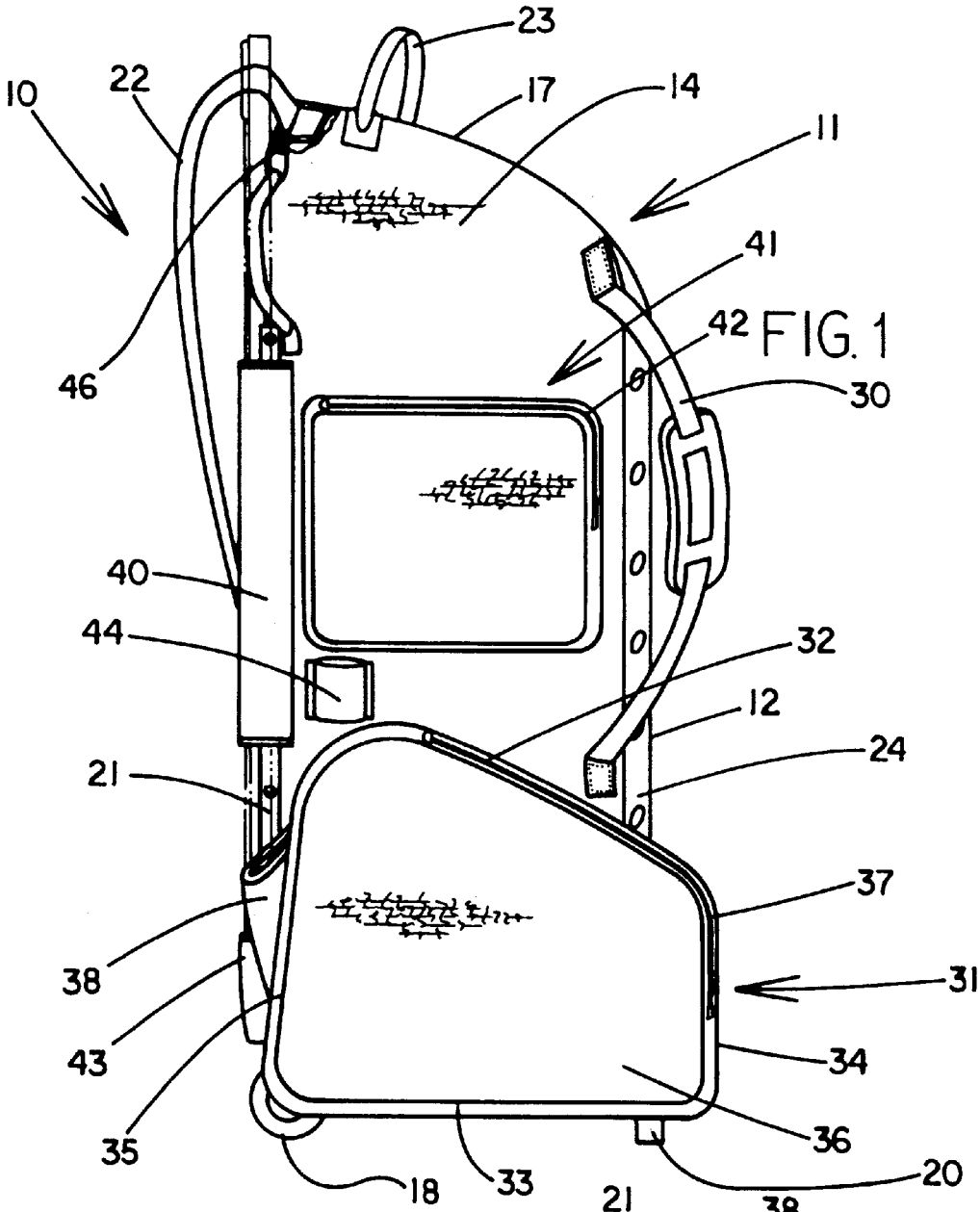
FIG. 1 is a schematic side view of a new hockey equipment bag according to the present invention.
Figure 2:
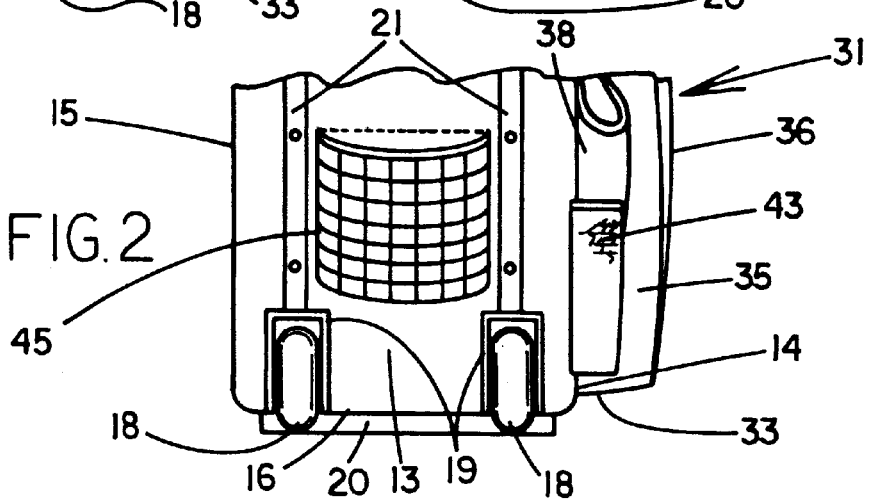
FIG. 2 is a schematic partial back view of the present invention.
Figure 3:
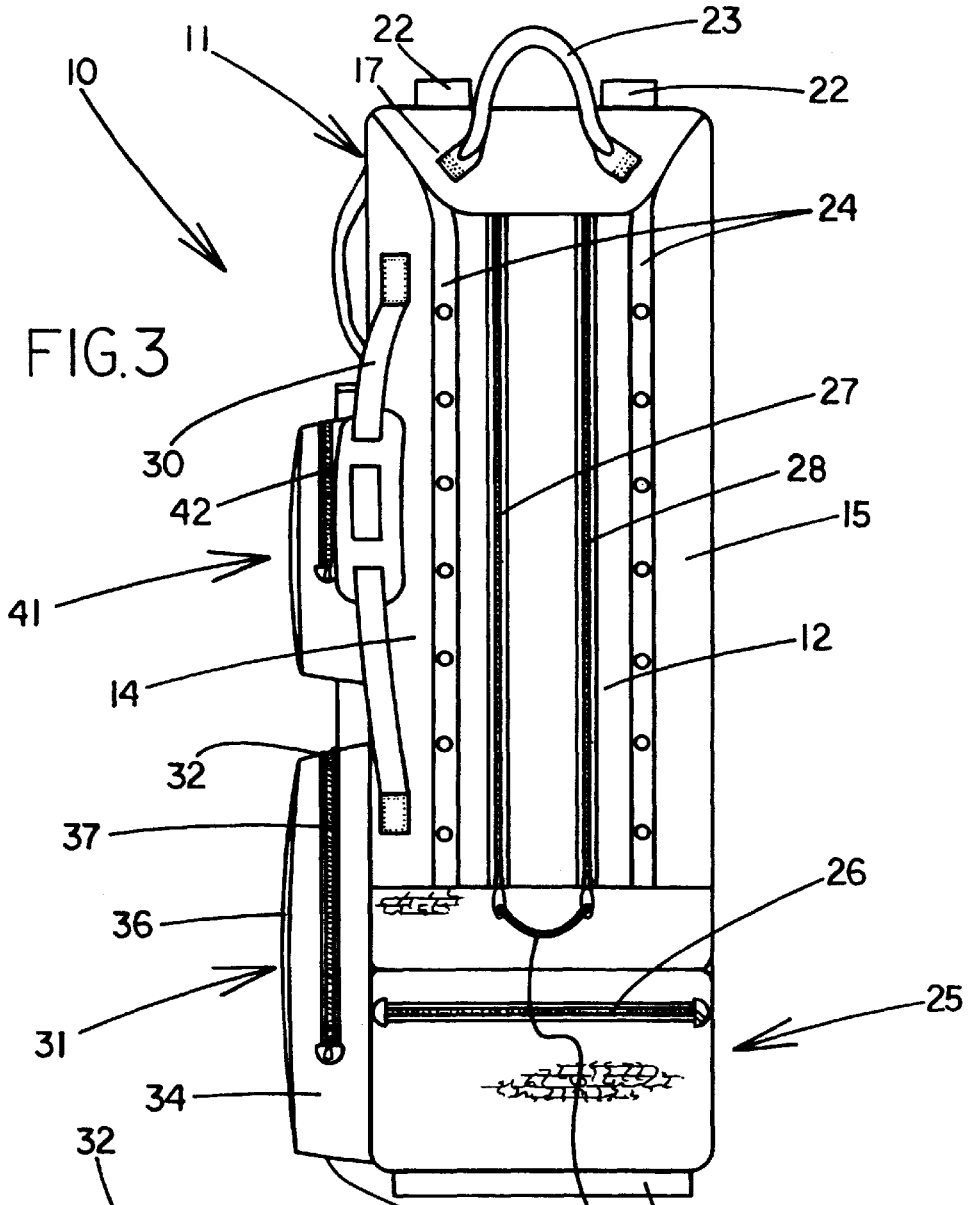
FIG. 3 is a schematic front view of the present invention.

With reference now to the drawings, and in particular to FIGS. 1 through 4 thereof, a new hockey equipment bag embodying the principles and concepts of the present invention and generally designated by the reference numeral 10 will be described.

As best illustrated in FIGS. 1 through 4, the hockey equipment bag 10 generally comprises a main compartment with a spaced apart pair of ground engaging wheels rotatably mounted to a bottom panel of the main compartment. A back panel of the main compartment has a spaced apart pair of shoulder straps coupled thereto. A top panel of the main compartment has a handle strap coupled thereto. A lower front compartment is coupled to the front panel of the main compartment. The front panel of the main compartment has a spaced apart pair of substantially parallel elongate slits into the main compartment. A first side panel of the main compartment has a shoulder strap coupled thereto. Upper and lower side compartments are coupled to the first side panel. The lower side compartment has generally L-shaped pocket therein. An elongate tubular shaft sleeve coupled to the first side panel adjacent the back panel of the main compartment.

In closer detail, hockey equipment bag 10 comprises a main compartment 11 having top, bottom, front, back and a pair of side panels and is designed for holding hockey equipment therein. The front and back panels 12,13 of the main compartment preferably lie in substantially parallel planes to one another. The side panels 14,15 of the main compartment preferably lie in planes converging towards one another in a direction from the back panel towards the front panel of the main compartment. The bottom panel 16 of the main compartment preferably lies in a plane substantially perpendicular to the front, back and side panels of the main compartment. The top panel 17 of the main compartment preferably lies in a plane extending at an acute angle to the plane of the back panel. The plane of the top panel of the main compartment is also extended at an acute angle to the plane of the back panel of the main compartment and at an obtuse angle to the plane of the front panel of the main compartment such that the top panel of the main compartment slopes downwards from the back panel of the main compartment to the front panel of the main compartment.

The main compartment has a spaced apart pair of ground engaging wheels 18 rotatably mounted to bottom panel of the main compartment. The wheels are positioned adjacent the back panel of the main compartment. In use, the wheels are designed for permitting rolling of the equipment bag across a ground surface. Preferably, the main compartment has a pair of recesses 19 therein with one of the wheels positioned in one of the recesses and the other wheel positioned in the other recess.

The bottom panel of the main compartment preferably has a ground engagable resting stop 20 downwardly depending therefrom. The resting stop is positioned adjacent the front panel of the compartment and extends between the side panels of the main compartment. In use, the resting stop is designed for keeping the equipment bag horizontally level when the resting stop engages a ground surface.

Preferably, the back panel of the main compartment has a spaced apart pair of rigid elongate rear support strips 21 thereon extending between the top and bottom panels of the main compartment. The rear support strips are extended substantially parallel to one another with one of the rear support strips positioned adjacent one of the wheels and the other rear support strip positioned adjacent the other wheel. In use, the rear support strips are designed for helping support the main compartment vertically upright.

The back panel of the main compartment has a spaced apart pair of flexible shoulder straps 22 coupled thereto and positioned towards the top panel of the main compartment. One of the shoulder straps of the back panel is positioned adjacent one of the rear support strips and the other shoulder strap of the back panel is positioned adjacent the other rear support strip.

The top panel of the main compartment has a flexible handle strap 23 coupled thereto. Preferably, the handle strap lies in a plane extending generally parallel to the planes of the front and back panels of the main compartment. In use, the handle strap is designed for permitting a user to hand lift the equipment bag with the handle strap and to also permit hanging therewith of the equipment bag on a hanging hook.

The front panel of the main compartment preferably has a pair of rigid elongate front support strips 24 extending between the top panel and the bottom panel of the main compartment. The front support strips are preferably extended substantially parallel to one another. One of the front support strips is positioned adjacent one of the side panels of the main compartment while the other of the front support strips is positioned adjacent the other of the side panels of the main compartment. In use, the front support strips are designed for helping support the main compartment vertically upright.

A lower front compartment 25 is coupled to the front panel of the main compartment and positioned adjacent the bottom panel of the main compartment. In use, the lower front compartment is designed for holding therein smaller pieces of hockey equipment than in the main compartment. The lower front compartment has a front slit 26 therein extending in a direction between the side panels of the main compartment. The lower front compartment has a zipper closing the front slit opening of the front compartment.

The front panel of the main compartment has a spaced apart pair of substantially parallel elongate slits 27,28 into the main compartment which are extended between the top panel of the main compartment and the lower front compartment. The front panel of the main compartment has a pair of zippers closing the slits openings of the front panel. Preferably, a flexible cord 29 connects the zippers of the front panel together to permit simultaneous opening and closing of the slits openings of the front panel with the zippers of the front panel.

A first of the side panels has a flexible shoulder strap 30 coupled thereto. In use, the shoulder strap of the first side panel is designed for permitting a user to carry the equipment bag therewith.

A lower side compartment 31 is also coupled to the first side panel of the main compartment. In use, the lower side compartment is designed for holding a pair of skates therein. The lower side compartment has a top 32, a bottom 33, a front 34, a back 35, and an outer side 36. The bottom of the lower side compartment is positioned adjacent the bottom panel of the main compartment. The top of the lower side compartment is preferably extended at an acute angle to the bottom of the lower side compartment. The front of the lower side compartment is preferably extended generally perpendicular to the bottom of the lower side compartment while the back of the lower side compartment is extended at an acute angle to the bottom of the lower side compartment. The front of the lower side compartment is preferably outwardly extended from the plane of the front panel of the main compartment.

Figure 4:
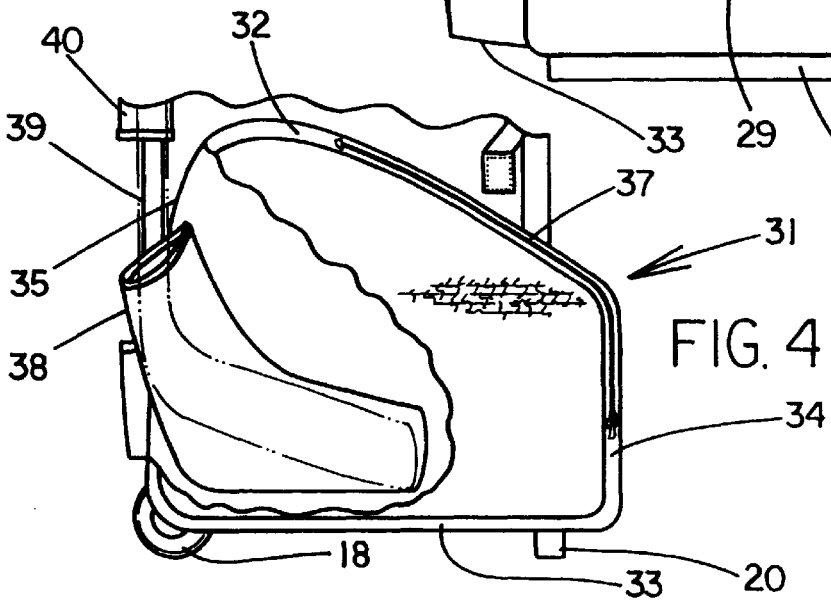
FIG. 4 is a schematic breakaway partial side view of the present invention.

The lower side compartment has an elongate slit 37 therein extending along the top and front of the lower side compartment with a zipper closing this slit. The lower side compartment has generally L-shaped pocket 38 therein at the back of the lower side compartment. As illustrated in FIG. 4, in use, the pocket of the lower side compartment is designed for receiving a blade of a hockey stick 39 therein such that a shaft of the hockey stick upwardly extends from the pocket of the lower side compartment. An elongate tubular shaft sleeve 40 is preferably coupled to the first side panel of the main compartment adjacent the back panel of the main compartment. In use, the shaft sleeve is designed for extending the upwardly extending shaft of the hockey stick inserted into the pocket of the lower side compartment.

A generally rectangular upper side compartment 41 is coupled to the first side panel of the main compartment between the top panel of the main compartment and the lower side compartment. Like the lower side compartment, the upper side compartment has a top, a bottom, a front, a back and an outer side. The upper side compartment has an elongate slit 42 therein extending along the top and front of the upper side compartment and which is closed by a zipper.

A stick pouch 43 is preferably coupled to the back panel of the main compartment adjacent the bottom panel and first side panel of the main compartment. In use, the stick pouch is designed for receiving an end of a ringette stick therein.

Ideally, a water bottle pouch 44 is coupled to the first side panel adjacent the back panel between the upper and lower side compartments. In use, the water bottle pouch is designed for holding a water bottle.

Ideally, an expandable mesh laundry pouch 45 is coupled to the back panel for storing items therein.

Inside the main compartment is a hanging hook 46 or loop coupled to the top panel preferably positioned towards the back panel. This hanging hook or loop is designed for hanging coat hangers thereon so that clothes and coats may be hung in the main compartment in an organized manner.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. An equipment bag, comprising:

a main compartment comprising top, bottom, front, back and a pair of side panels;

said main compartment having a spaced apart pair of ground engaging wheels rotatably mounted to bottom panel of said main compartment;

said back panel of said main compartment having a spaced apart pair of shoulder straps coupled thereto;

said top panel of said main compartment having a handle strap coupled thereto;

a lower front compartment being coupled to said front panel of said main compartment, said lower front compartment being positioned adjacent said bottom panel of said main compartment;

said lower front compartment having a front opening therein;

said front panel of said main compartment having a spaced apart pair of substantially parallel elongate openings into said main compartment;

a first of said side panels having a shoulder strap coupled thereto;

a lower side compartment being coupled to said first side panel of said main compartment;

said lower side compartment having an elongate opening therein;

said lower side compartment having generally L-shaped pocket therein;

an elongate tubular shaft sleeve coupled to said first side panel of said main compartment adjacent said back panel of said main compartment;

an upper side compartment being coupled to said first side panel of said main compartment between said top panel of said main compartment and said lower side compartment; and said upper side compartment having an elongate opening therein.

2. The equipment bag of claim 1, wherein said front and back panels of said main compartment lie in generally parallel planes to one another, and wherein said side panels of said main compartment lie in planes converging towards one another in a direction from said back panel towards said front panel of said main compartment.

3. The equipment bag of claim 1, wherein said main compartment has a pair of recesses therein, one of said wheels being positioned in one of said recesses of said main compartment, the other of said wheels being positioned in the other of said recesses of said main compartment.

4. The equipment bag of claim 1, wherein said bottom panel of said main compartment has a resting stop downwardly depending therefrom.

5. The equipment bag of claim 1, wherein said back panel of said main compartment having a spaced apart pair of elongate rear support strips thereon extending between said top and bottom panels of said main compartment.

6. The equipment bag of claim 5, wherein one of said shoulder straps of said back panel is positioned adjacent one of said rear support strips, and the other of said shoulder straps of said back panel is positioned adjacent the other of said rear support strips.

7. The equipment bag of claim 1, wherein said front panel of said main compartment has a pair of elongate front support strips extending between said top panel and said bottom panel of said main compartment, said front support strips being extended substantially parallel to one another, one of said front support strips being positioned adjacent one of said side panels of said main compartment, the other of said front support strips being positioned adjacent the other of said side panels of said main compartment.

8. The equipment bag of claim 1, wherein said lower side compartment has a top, a bottom, a front, a back, and an outer side, said bottom of said lower side compartment being positioned adjacent said bottom panel of said main compartment, said top of said lower side compartment being extended at an acute angle to said bottom of said lower side compartment, said front of said lower side compartment being extended generally perpendicular to said bottom of said lower side compartment, said back of said lower side compartment being extended at an acute angle to said bottom of said lower side compartment.

9. The equipment bag of claim 1, further comprising a stick pouch being coupled to said back panel of said main compartment adjacent said bottom panel and first side panel of said main compartment.

10. An equipment bag, comprising:

a main compartment comprising top, bottom, front, back and a pair of side panels;

said front and back panels of said main compartment lying in substantially parallel planes to one another;

said side panels of said main compartment lying in planes converging towards one another in a direction from said back panel towards said front panel of said main compartment;

said bottom panel of said main compartment lying in a plane substantially perpendicular to said front, back and side panels of said main compartment;

said top panel of said main compartment lying in a plane extending at an acute angle to said plane of said back panel, said plane of said top panel of said main compartment being extended at an acute angle to said plane of said back panel of said main compartment and at an obtuse angle to said plane of said front panel of said main compartment such that said top panel of said main compartment slopes downwards from said back panel of said main compartment to said front panel of said main compartment;

said main compartment having a spaced apart pair of ground engaging wheels rotatably mounted to bottom panel of said main compartment, said wheels being positioned adjacent said back panel of said main compartment;

said main compartment having a pair of recesses therein, one of said wheels being positioned in one of said recesses of said main compartment, the other of said wheels being positioned in the other of said recesses of said main compartment;

said bottom panel of said main compartment having a resting stop downwardly depending therefrom, said resting stop being positioned adjacent said front panel of said compartment and extending between said side panels of said main compartment;

said back panel of said main compartment having a spaced apart pair of elongate rear support strips thereon extending between said top and bottom panels of said main compartment;

said rear support strips being extended substantially parallel to one another, one of said rear support strips being positioned adjacent one of said wheels, the other of said rear support strips being positioned adjacent the other of said wheels;

said back panel of said main compartment having a spaced apart pair of shoulder straps coupled thereto, said shoulder straps of said back panel being positioned towards said top panel of said main compartment;

one of said shoulder straps of said back panel being positioned adjacent one of said rear support strips, the other of said shoulder straps of said back panel being positioned adjacent the other of said rear support strips;

said top panel of said main compartment having a handle strap coupled thereto;

said handle strap lying in a plane extending generally parallel to said planes of said front and back panels of said main compartment;

said front panel of said main compartment having a pair of elongate front support strips extending between said top panel and said bottom panel of said main compartment;

said front support strips being extended substantially parallel to one another;

one of said front support strips being positioned adjacent one of said side panels of said main compartment, the other of said front support strips being positioned adjacent the other of said side panels of said main compartment;

a lower front compartment being coupled to said front panel of said main compartment, said lower front compartment being positioned adjacent said bottom panel of said main compartment;

said lower front compartment having a front opening therein, wherein said lower front compartment has a zipper closing said front opening of said front compartment;

said front panel of said main compartment having a spaced apart pair of substantially parallel elongate openings into said main compartment, said openings of front panel being extended between said top panel of said main compartment and said lower front compartment;

said front panel of said main compartment having a pair of zippers closing said openings of said front panel;

a first of said side panels having a flexible shoulder strap coupled thereto;

a lower side compartment being coupled to said first side panel of said main compartment;

said lower side compartment having a top, a bottom, a front, a back, and an outer side;

said bottom of said lower side compartment being positioned adjacent said bottom panel of said main compartment;

said top of said lower side compartment being extended at an acute angle to said bottom of said lower side compartment;

said front of said lower side compartment being extended generally perpendicular to said bottom of said lower side compartment;

said back of said lower side compartment being extended at an acute angle to said bottom of said lower side compartment;

said lower side compartment having an elongate slit opening therein extending along said top and front of said lower side compartment;

wherein said lower side compartment has a zipper closing said opening of said lower side compartment;

said front of said lower side compartment being outwardly extended from said plane of said front panel of said main compartment;

said lower side compartment having generally L-shaped pocket therein at said back of said lower side compartment, said pocket of said lower side compartment being adapted for receiving a blade of a hockey stick therein such that a shaft of the hockey stick upwardly extends from said pocket of said lower side compartment;

an elongate tubular shaft sleeve coupled to said first side panel of said main compartment adjacent said back panel of said main compartment, said shaft sleeve being adapted for extending the upwardly extending shaft of the hockey stick inserted into said pocket of said lower side compartment;

a generally rectangular upper side compartment being coupled to said first side panel of said main compartment between said top panel of said main compartment and said lower side compartment;

said upper side compartment having a top, a bottom, a front, a back and an outer side;

said upper side compartment having an elongate opening therein extending along said top and front of said upper side compartment;

wherein said upper side compartment has a zipper closing said opening of said upper side compartment; and a stick pouch being coupled to said back panel of said main compartment adjacent said bottom panel and first side panel of said main compartment.

* * * * *